US009822956B2

(12) United States Patent
Eichel

(10) Patent No.: US 9,822,956 B2
(45) Date of Patent: Nov. 21, 2017

(54) SYSTEM AND METHOD FOR CALIBRATING A FIXTURE CONFIGURED TO ROTATE AND/OR TRANSLATE

(71) Applicant: CAST GROUP OF COMPANIES INC., Toronto (CA)

(72) Inventor: Justin Eichel, Waterloo (CA)

(73) Assignee: CAST Group of Companies Inc., Toronto (CA)

( * ) Notice: Subject to any disclaimer, the term of this patent is extended or adjusted under 35 U.S.C. 154(b) by 623 days.

(21) Appl. No.: 14/370,766

(22) PCT Filed: Jan. 4, 2013

(86) PCT No.: PCT/CA2013/050003
§ 371 (c)(1),
(2) Date: Jul. 4, 2014

(87) PCT Pub. No.: WO2013/102273
PCT Pub. Date: Jul. 11, 2013

(65) Prior Publication Data

US 2015/0003084 A1 Jan. 1, 2015

Related U.S. Application Data

(60) Provisional application No. 61/583,593, filed on Jan. 5, 2012.

(51) Int. Cl.
*F21V 21/14* (2006.01)
*F41G 5/26* (2006.01)

(52) U.S. Cl.
CPC ..... *F21V 21/14* (2013.01); *F41G 5/26* (2013.01)

(58) Field of Classification Search
CPC ..... F41G 5/26
(Continued)

(56) References Cited

U.S. PATENT DOCUMENTS 6,044,308 A * 3/2000 Huissoon ..... B25J 9/1692 700/166
6,423,923 B1 * 7/2002 Siniaguine ..... H05H 1/44 219/121.5

(Continued)

FOREIGN PATENT DOCUMENTS

EP 0814344 A2 12/1997

OTHER PUBLICATIONS

Volpe, R. and McAffee, D.; A Robotic Lighting System for Solar Illumination Simulation; IEEE International Conference on Robotics and Automation, 1994. vol. 4, pp. 3474-3479.

(Continued)

*Primary Examiner* — Luis Perez Fuentes
(74) *Attorney, Agent, or Firm* — Blake, Cassels & Graydon LLP; Wilfred P. So

(57) ABSTRACT

Systems and methods are provided for calibrating equipment, such as a lighting fixture. A kinematic model of the lighting fixture is obtained. Test points, which include a pair of a corresponding control signal and an output are collected. These can be collected using a tracking system. The test points are then used to update the kinematic model of the lighting fixture. The process of updating the kinematic model can include the use of a Kalman filter. The calibration is then verified and may be re-calibrated. These methods can also be used to calibrate other equipment, for example, lasers, light projectors showing media content, audio speaker, microphones, cameras, and projectile equipment.

21 Claims, 21 Drawing Sheets

(58) Field of Classification Search
USPC ..... 362/419; 375/240
See application file for complete search history.

(56) References Cited

U.S. PATENT DOCUMENTS

| | | | | |
|---|---|---|---|---|
| 7,272,524 | B2 * | 9/2007 | Brogardh | B25J 9/1671 700/193 |
| 7,352,446 | B2 * | 4/2008 | Bridges | G01B 11/024 356/5.13 |
| 8,300,219 | B1 * | 10/2012 | Gordin | H01Q 1/1242 356/139.01 |
| 8,854,594 | B2 * | 10/2014 | Densham | H04N 5/2224 342/451 |
| 2002/0176603 | A1 * | 11/2002 | Bauer | G06T 1/0057 382/100 |
| 2012/0050535 | A1 * | 3/2012 | Densham | H04N 5/2224 348/159 |

OTHER PUBLICATIONS

Moreau, Jacinthe; International Search Report from corresponding PCT Application No. PCT/CA2013/050003; search completed on Mar. 7, 2013.

* cited by examiner

FIG. 20

| Variable | Description | Parameters |
|---|---|---|
| **X** | Parameters of the light fixture | (x, y, z, rx, ry, rz, pan_trans, tilt_trans, focus_trans) |
| $\tilde{\mathbf{X}}$ | Estimate of the parameters of the light fixture | (x, y, z, rx, ry, rz, pan_trans, tilt_trans, focus_trans) |
| **Y** | Coordinates of the spotlight | (x, y, z) |
| **Ra** | Coordinates of the specified target | (x, y, z) |
| **Rb** | Measured coordinates of spotlight after executing **Ua** | (x, y, z) |
| **U** | Control signal | (pan_control, tilt_control, focus_control) |
| **Ua** | Control signal generated from Inverse Kinematic Model | (pan_control, tilt_control, focus_control) |
| **Ub** | Control signal to move spotlight from **Y** to **Ra** after executing **Ua** | (pan_control, tilt_control, focus_control) |
| **Uc** | Control signal to move the object that the light fixture is mounted to | n/a |

FIG. 21

| Parameter | Description |
|---|---|
| x | x-coordinate |
| y | y-coordinate |
| z | z-coordinate |
| rx | angle in yz-plane about the x-axis |
| ry | angle in xz-plane about the y-axis |
| rz | angle in xy-plane about the z-axis |
| pan_trans | transformation applied to desired pan to convert it into a pan_control control signal |
| tilt_trans | transformation applied to desired tilt to convert it into a tilt_control control signal |
| focus_trans | transformation applied to desired focus to convert it into a focus_control control signal |
| pan_control | control signal for panning the spotlight |
| tilt_control | control signal for tilting the spotlight |
| focus_control | control signal for focusing the spotlight |

SYSTEM AND METHOD FOR CALIBRATING A FIXTURE CONFIGURED TO ROTATE AND/OR TRANSLATE

CROSS-REFERENCE TO RELATED APPLICATIONS

This application claims priority to U.S. Provisional Application No. 61/583,593, filed on Jan. 5, 2012, the entire contents of which are incorporated herein by reference.

TECHNICAL FIELD

The following relates generally to calibrating equipment.

DESCRIPTION OF THE RELATED ART

Calibrating equipment, such as lighting devices for example, can be difficult and time consuming. For example, a light fixture is positioned in a physical space, such as in a room, and it can be moved to point at different locations. Calibrating a light fixture can involve determining where the light fixture is located and how the light fixture is operated. This can be done manually. When lights or other equipment are not calibrated, the response of the lights or equipment may be undesirable and unexpected. For example, a light fixture that is not calibrated may not point at the desired location as commanded.

BRIEF DESCRIPTION OF THE DRAWINGS

Example embodiments will now be described by way of example only with reference to the appended drawings wherein:

FIG. 20 is a table showing a list of variables.

FIG. 21 is a table showing a list of parameters.

DETAILED DESCRIPTION

Figure 1:
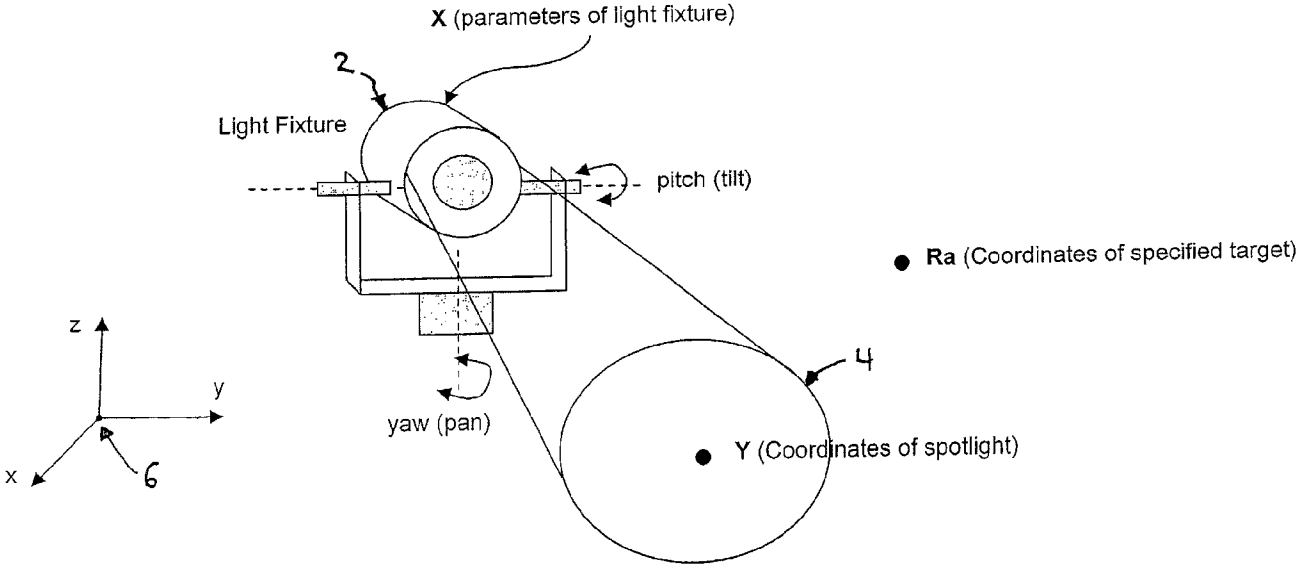
FIG. 1 a schematic diagram of an example light fixture.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures and components have not been described in detail so as not to obscure the example embodiments described herein. Also, the description is not to be considered as limiting the scope of the example embodiments described herein.

It will be appreciated that the examples described herein refer to calibrating light fixtures. However, the example embodiments can also be used to calibrate other equipment. Non-limiting examples of other equipment include lasers, light projectors showing media content, audio speaker, microphones, cameras, and projectile equipment (e.g. guns, cannons, water cannons, etc.).

Turning to FIG. 1, an example light fixture 2 is shown. Examples of such a lighting fixture include a moving head light fixture and a moving mirror light fixture. The light beam can move about different axes. For example, it can pitch (e.g. tilt) and yaw (e.g. pan). The location of the light fixture's spotlight 4 can have coordinates in three-dimensional space. The frame of reference can be a point of origin 6 identified using the Cartesian coordinate system. The coordinates of the spotlight 4 can be represented as Y. The parameters to control the light fixture can be represented by X.

The point Ra represents the coordinates of a specified target.

Figure 2:
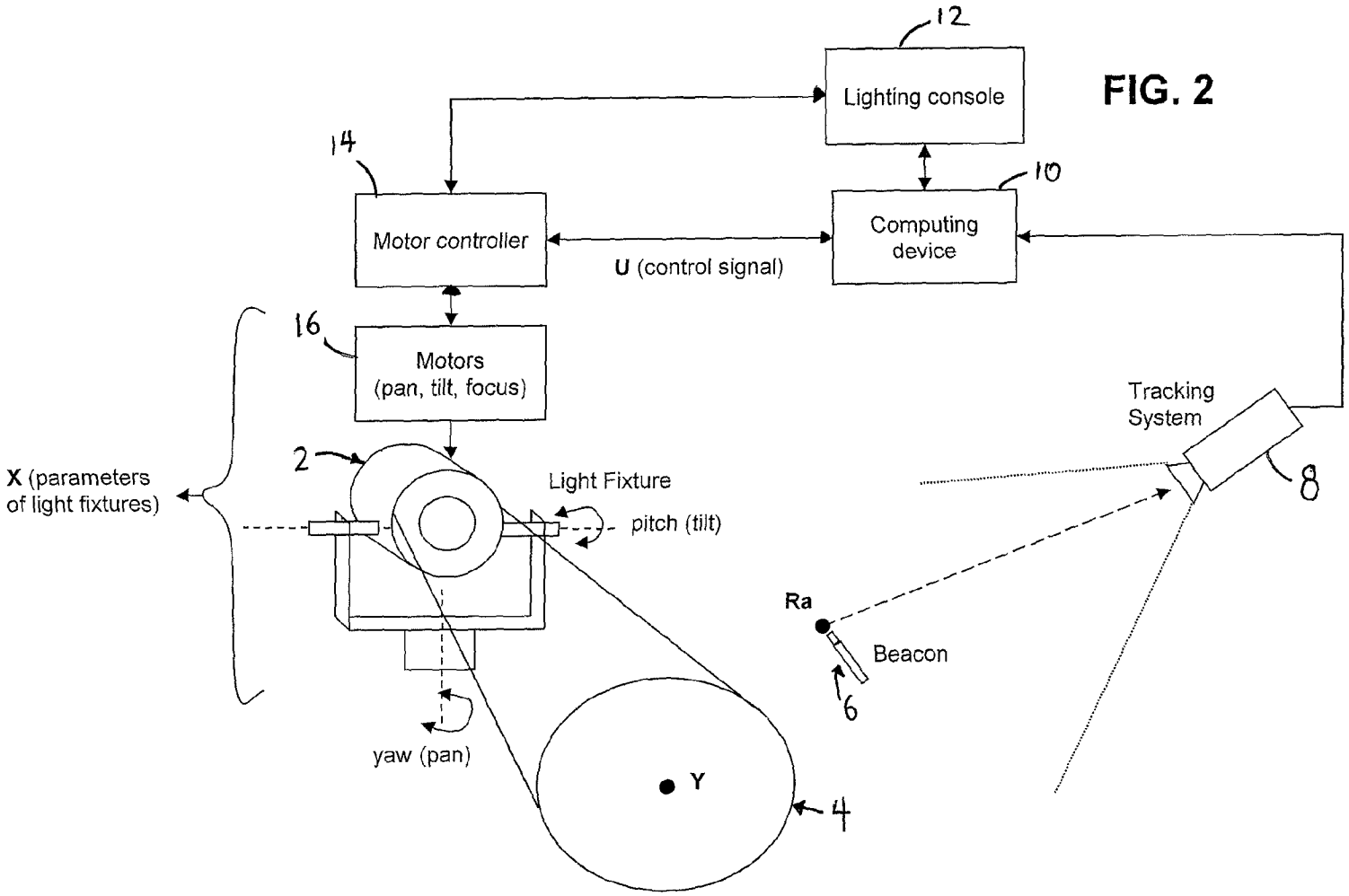
FIG. 2 is a schematic diagram of an example light fixture, a computing device and a tracking system used to calibrate the light fixture.

Turning to FIG. 2, the light fixture 2 can be controlled using one or motors 16 used to control the tilt, pan and the focus of light. A controller 14 can control the motors 16. The controller 14 can communicate data with a lighting console 12 and a computing device 10. The computing device 10 can send a control signal U to the motor controller 14 to, in turn, affect the light fixture 2. The lighting console 12 can also exchange data with the computing device 10, and can also be used to receive inputs from the user. For example, a user controls the light fixture 2 using the lighting console 12.

A tracking system 8 is in communication with the computing device 10. The tracking system can track the location of a beacon 6. In an example embodiment, the tracking system includes infrared cameras and a transceiver that is able to communicate with the beacon 6. The beacon includes an infrared light which can be visually tracked by the infrared cameras, and inertial sensors (e.g. accelerometer and gyroscope). The data from the inertial sensors is transmitted to the transceiver in the tracking system 8. In this way, the beacon's position and angular orientation is able to be tracked. A non-limiting example of a tracking system that includes a beacon, and that can be used with the example embodiments described herein, is described in United States Patent Application Publication No. 2012/0050535, published on Mar. 1, 2012, the entire contents of which are incorporated by reference. Other tracking systems (e.g. SONAR, RFID, image tracking) can also be used with the example embodiments described herein.

The beacon 6 can be used to mark the location of a specified target Ra, for example, in three-dimensional (3D) space. In other words, in an example embodiment, the location of the beacon 6, which is tracked using the tracking system 8, is the specified target Ra.

Figure 3:
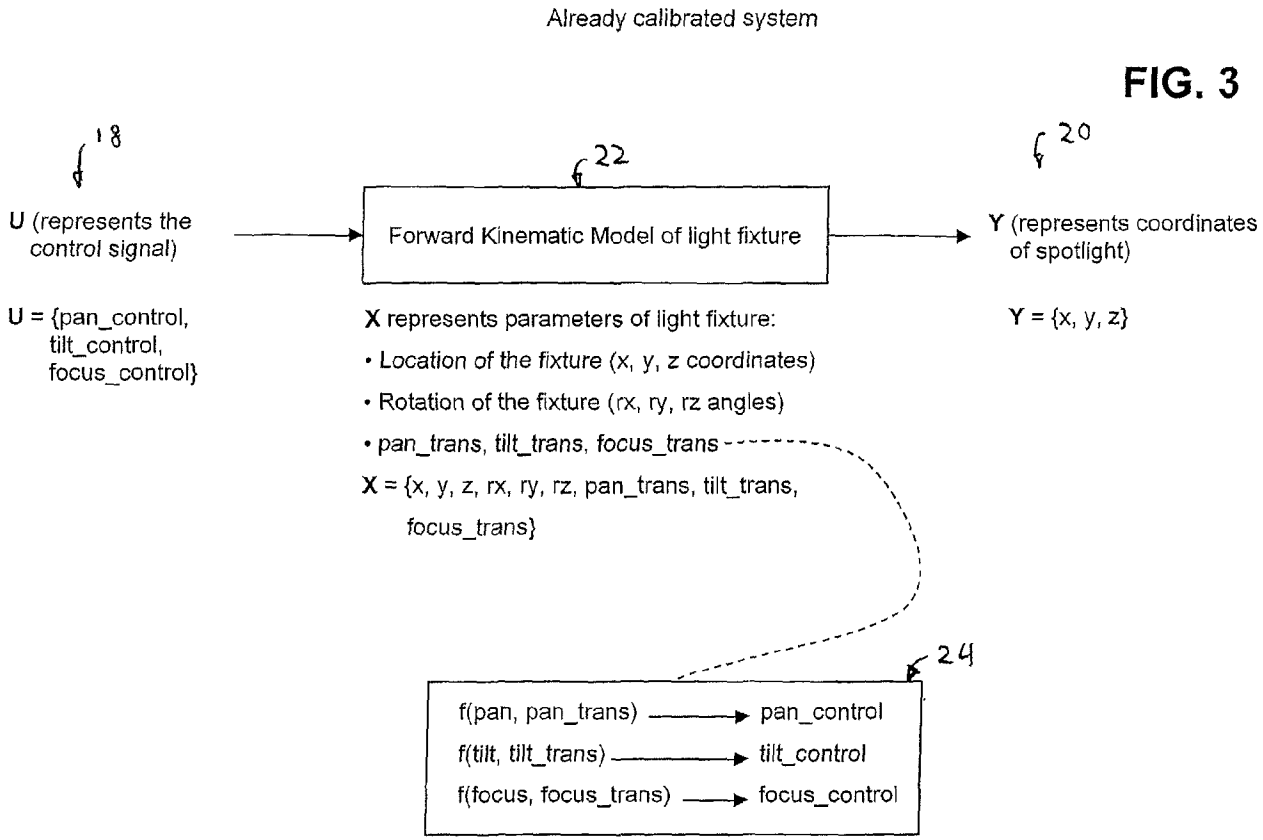
FIG. 3 is a block diagram of an example data model of a calibrated system.

An example data model of a calibrated system, for example, a calibrated light fixture, is described in FIG. 3. It can be appreciated that various symbols, such as variables and parameters, which are used throughout the present application, are briefly described in FIG. 20 and FIG. 21.

Turning to FIG. 3, an input 18 is provided to a forward kinematic model of a light fixture 22, which generates an output 20. The input 18 is a control signal U which can comprise values for controlling a signal for panning the spotlight (e.g. pan_control), a signal for tilting the spotlight (e.g. tilt_control) and a signal for focusing the spotlight (e.g. focus_control). These control signals are processed by the light fixture system to move the spotlight to a certain position Y, represented by x,y,z coordinates. The resulting position of the spotlight Y is the output 20 of the model 22.

The model 22 can be considered a mathematical representation of the light fixture. The parameters of the light fixture is broadly represented by X. More generally, X is associated with the kinematic model of a fixture. The variable X includes parameters for the location of the fixture (e.g. x,y,z coordinates), the rotation of the fixture (e.g. rx, ry, yz angles) and a transformation values used to transform or convert desired values into corresponding control signals. For example, the light fixture 2 is commanded to pan 20 degrees. However, the light fixture 2, or its controller 14, requires a different control signal to achieve the movement of panning 20 degrees. The control signal can, for example, be an integer and be limited to a range of numbers.

As shown in box 24, a function is applied to a desired pan angle (e.g. pan) and the pan transformation (e.g. pan_trans) to compute the corresponding pan_control value. Similarly, by applying a function to the tilt angle and the tilt_trans value, and to the focus parameter and the focus_trans value, the corresponding tilt_control and focus_control values can be computed, respectively.

Given a control signal U, the model 22 will compute or output the coordinates of the spotlight Y as expected, or desired for a calibrated system.

In a system that is not calibrated, given a control signal to point a spot light at a desired location, the light fixture 2 may point the spot light at a different location other than the desired location. This may be because the control signal U is no accurate, or the model 22 of the light fixture having the variable X is incorrect, or both.

The parameters defining X can be adjusted to more accurately represent the physical features of the light fixture 2.

Figure 4:
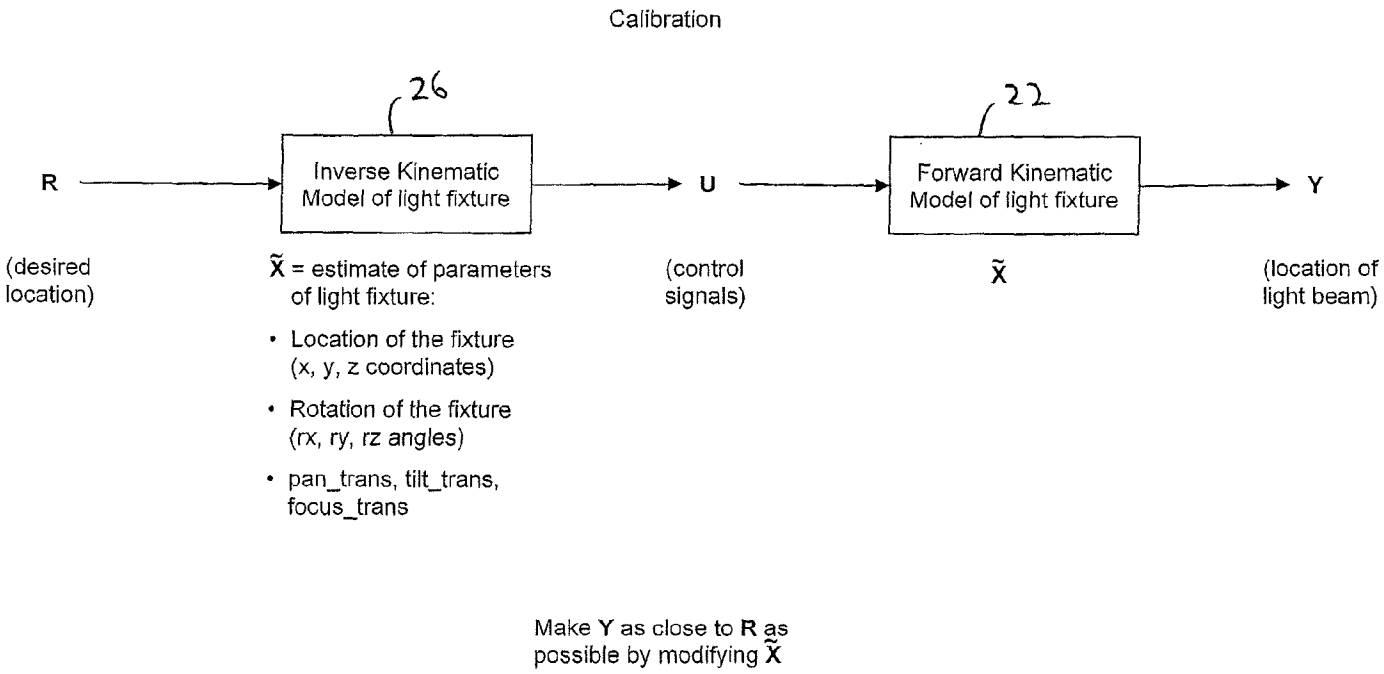
FIG. 4 is a block diagram of an example data model used to calibrate a system.

Turning to FIG. 4, an example data model is provided for calibrating a light fixture. An inverse kinematic model of the same light fixture 26 is provided. It corresponds with the forward kinematic model of the light fixture 22. An input R is provided to the inverse kinematic model 26, and the inverse kinematic model 26 is used to compute a control signal U for the light fixture. R represents the desired location of the light and can be represented by coordinates x,y,z. More generally, R represents the desired location at which the fixture is to point.

The output U from the inverse kinematic model 26 can be used as the input control signal U for the forward kinematic model 22. The output of the forward kinematic model 22 is Y.

If the parameters of both models, which can be represented by X, are accurate, then the location of the light beam Y should equal the desired location of the light beam R. This type of operation would occur in a calibrated system. However, if the parameters of X are incorrect, or do not accurately represent the light fixture (e.g. not calibrated), then Y will not equal R.

The example embodiments described herein provide systems and methods for determining values of X, with the goal of making the value of Y as close as possible to the value of R. This in turn calibrates the light fixture 2. The estimated values of X are represented herein as $\tilde{X}$.

Figure 5:
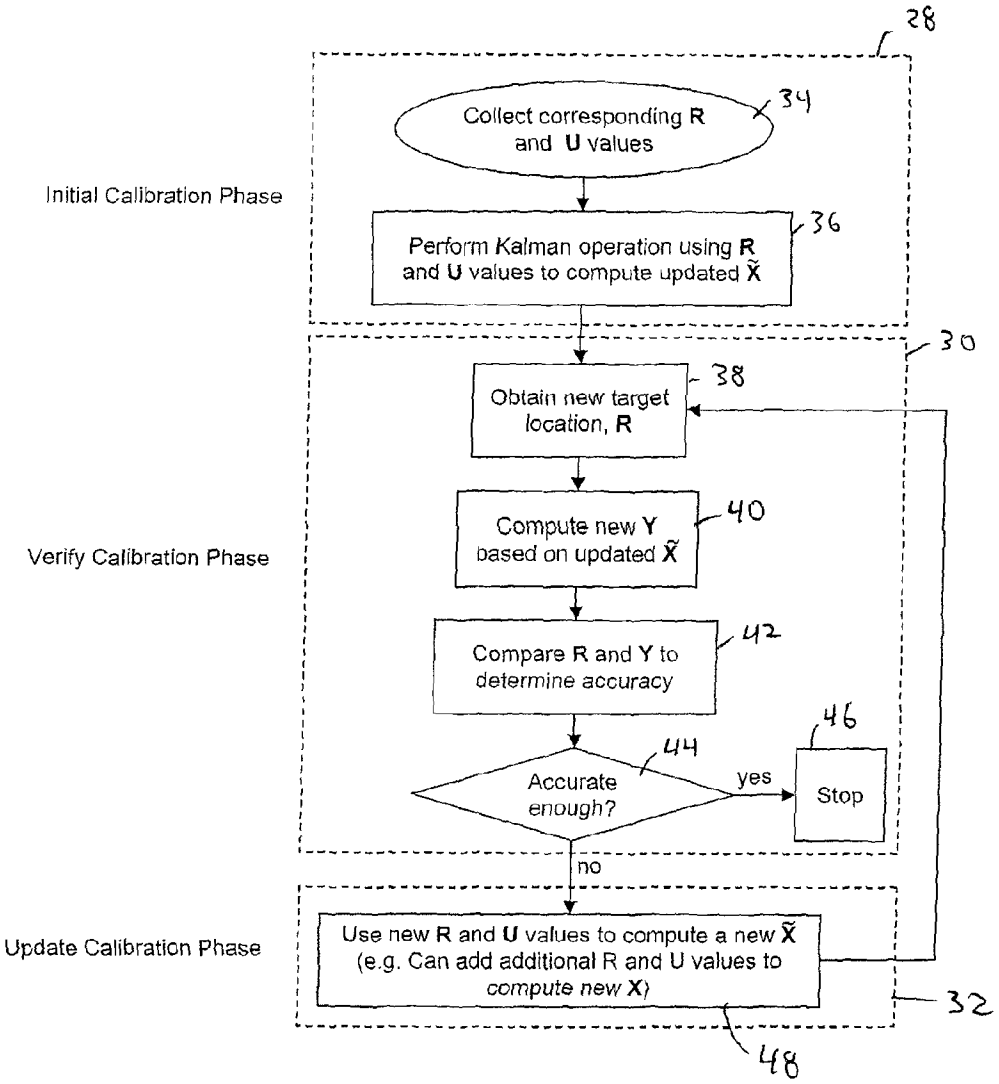
FIG. 5 is a flow diagram illustrating example computer executable instructions for calibrating equipment.

Turning to FIG. 5, example computer executable instructions are provided for calibrating equipment. One phase of the calibration process is the initial calibration phase 28. The initial calibration is verified according to the verify calibration phase 30. Under certain conditions, an update calibration phase 32 is performed.

In the initial calibration phase 28, values for R and U are collected (block 34). These are considered test points, which can be used to compute the parameters of $\tilde{X}$ (block 36). For example, a Kalman operation can be used to compute $\tilde{X}$. The parameters of $\tilde{X}$ represent the parameters of the model for an initially calibrated system.

The performance of the calibration is verified in phase 30. At block 38, the computing device 10 receives a new target location R. It then computes the new output Y using the recently computed $\tilde{X}$ (block 40). The computing device 10 compares the new target location R and the new output Y to determine the accuracy. If they are close enough to each other (e.g. accurate enough), then the process is stopped (blocks 44 and 46). If the values are not accurate enough as per block 44, then an updated calibrated phase 32 is performed. It can be appreciated that "close enough" is a parameter that can be defined by a user. The threshold for determining whether the calibration is accurate enough may, for example, depend on the circumstances.

At block 48, the new R and the new U values are used to compute a new $\tilde{X}$. The new R and the new U values act as additional test points that can be used to better determine the values of $\tilde{X}$. Additional R and U values can also be added when computing the new $\tilde{X}$.

Figure 6:
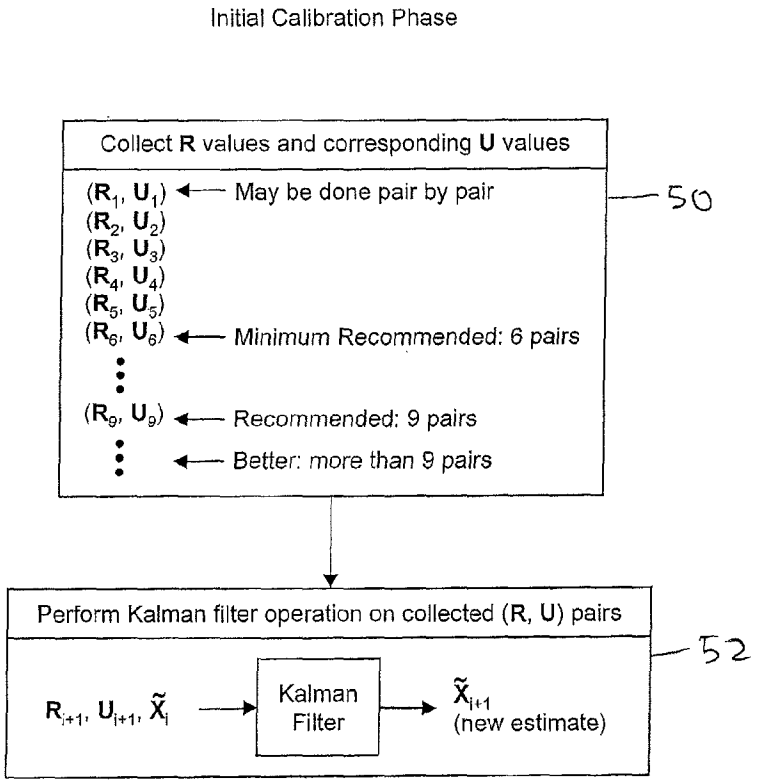
FIG. 6 is a flow diagram illustrating example computer executable instructions for an initial calibration phase.

Turning to FIG. 6, example computer executable instructions are provided for performing the calibration phase 28. At block 50, several pairs of corresponding R and U values received, or obtained. It can be appreciated that given a desired location, or specified target, R, the corresponding U value to achieve the specified target R can be determined, either through manual or automatic means. In another example, given a U value (e.g. control signal), the corresponding output R, or location of the spotlight can be determined. In this way, test points for R and U values are obtained.

In an example embodiment, it is recommended to use six pairs of R,U values or more. In another example embodiment, it is recommended that nine pairs of R, U values are obtained. In yet another example embodiment, more than nine pairs are recommended. In an example embodiment, using more R,U pairs provides more data to better determine the parameters of X. Different numbers of R,U pairs can be used with the example embodiments described herein.

At block 52, a Kalman filter operation is performed on the collected R,U pairs. For example, an initial estimate of $\tilde{X}$, represented generically as $\tilde{X}_i$, and the R,U pairs are inputted into the Kalman filter to output a new estimate $\tilde{X}_{i+1}$.

A Kalman filter is a mathematical method whose purpose is to use a series of measurements observed over time, containing noise (random variations) and other inaccuracies, and produce estimates that tend to be closer to the true unknown values than those that would be based on a single measurement alone. In an iterative process, an initial belief of a state, for example prior knowledge, is used to generate a prediction. The prediction or predictions are updated using measurements (e.g. the obtained R, U pairs), to output an estimate of the calibrated kinematic parameters of $\tilde{X}_{i+1}$.

Figure 7:
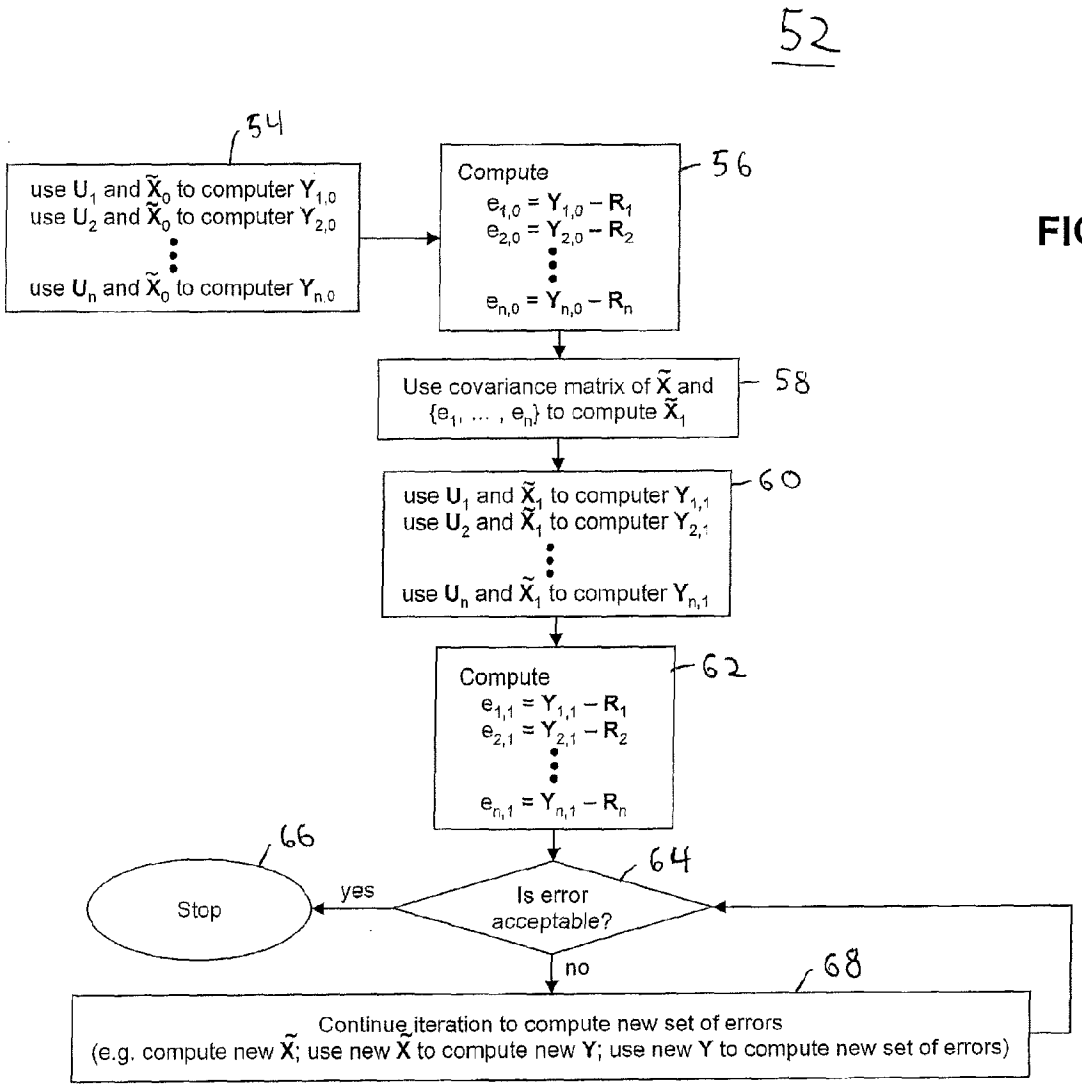
FIG. 7 is a flow diagram illustrating example computer executable instructions for computing calibrated parameters.

An example embodiment of a Kalman filter process is provided in FIG. 7. This shows example computations of block 52.

Referring to FIG. 7, at block 54, a $U_1$ of the first RU pair and the initial estimate or belief of $\tilde{X}_0$ is used to compute $Y_{1,0}$. This can be done using the forward kinematic model 22. Similarly other U values (e.g. $U_2, \ldots U_n$) are also used to compute corresponding Y values (e.g. $Y_{2,0}, \ldots Y_{n,0}$).

At block 56, the corresponding error values are computed. For example, $Y_{1,0}-R_1=e_{1,0}$ is used to compute the first error. Similarly, other error values are computed (e.g. $e_{n,0}=Y_{n,0}-R_n$).

At block 58, a covariance matrix of $\tilde{X}$ and the errors $\{e_{1,0}, \ldots, e_{n,0}\}$ are used to compute $\tilde{X}_1$. At block 60, $U_1$ and X1 are used to compute $Y_{1,1}$. This can be done using the forward kinematic model 22. The process is repeated for the other U values (e.g. $U_n$ and $\tilde{X}_1$ are used to compute $Y_{n,1}$).

At block 62, the newly calculated Y values are compared with the R values to determine if the error is acceptable or not. For example, the error value $e_{1,1}$ is computed by $Y_{1,1}$-$R_1$. If the error values $\{e_{1,1}, \ldots, e_{n,1}\}$ are determined to be acceptable (block 64) the process stops (block 66).

If the error values are not acceptable, then another iteration is computed using the above process. For example, a new $\tilde{X}$ is computed; this new $\tilde{X}$ is used to compute a new Y; and the new Y is used to compute a new set of errors. The obtained R,U pairs are used through these iterations. The iterations stop when the error is determined to be acceptable. In an example embodiment, a predetermined threshold is used to determine whether or not the error is acceptable. This generates an estimate $\tilde{X}$, which is calibrated.

Figure 8:
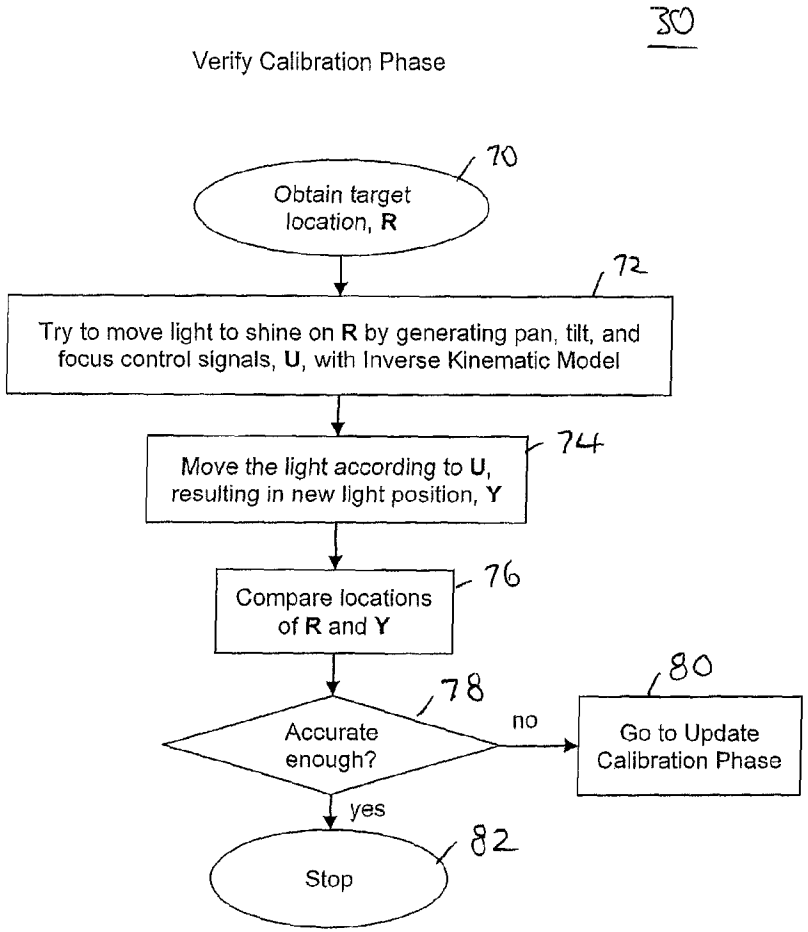
FIG. 8 is a flow diagram illustrating example computer executable instructions to verify the calibration.

However, the accuracy of the calibration can be verified according to the operations in FIG. 8, which show the verify calibration phase 30.

Referring to FIG. 8, example computer executable instructions are provided for verifying the calibration. At block 70, a target location R is obtained. The inverse kinematic model 26, which has the variable $\tilde{X}$ as computed according to the initial calibration phase 28, is used to compute the corresponding control signal U (block 72). At block 74, the computed control signal U is provided to the controller 14 to move the light fixture 2. The resulting location of the spotlight is Y. At block 76, the location of the spotlight Y is compared with the target location R. At block 78, it is determined if the locations are close enough. If so, the process is stopped (block 82), and the light fixture 2 and its related control components 16, 14 are considered sufficiently calibrated. If it is determined the locations of R and Y are not close enough, then the update calibration phase 32 is implemented (block 80).

Figure 9:
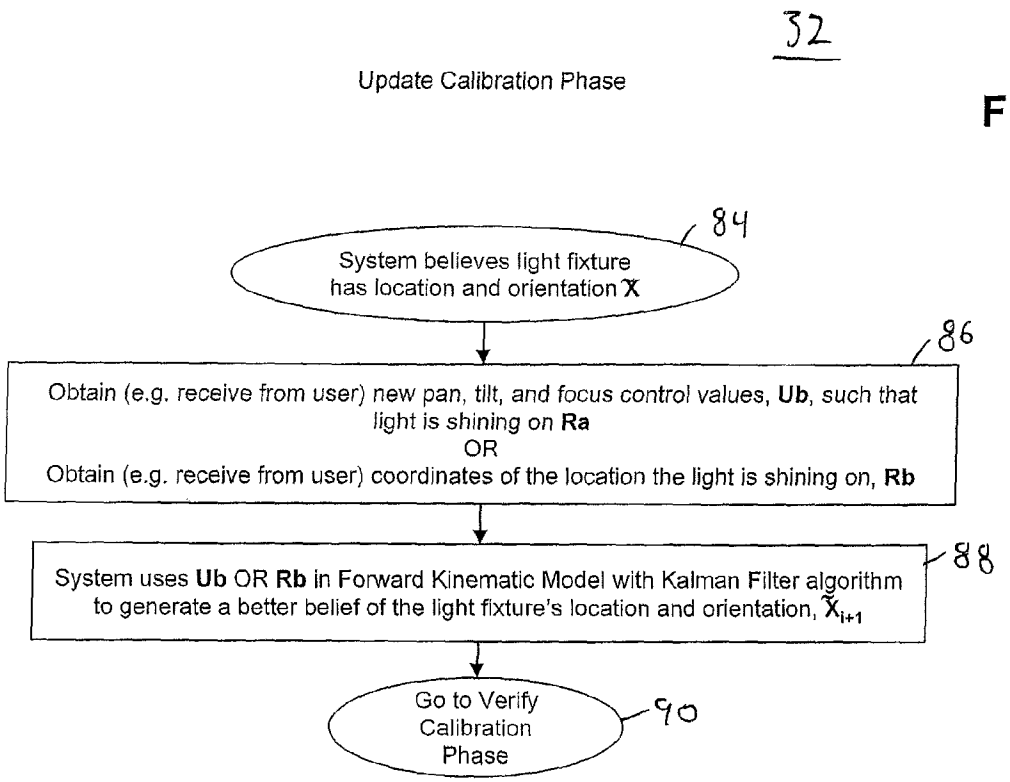
FIG. 9 is a flow diagram illustrating example computer executable instructions to update the calibration.

Turning FIG. 9, an example of the update calibration phase 32 is provided. At block 84, the system (e.g. computing device 10) believes the light fixture has a location and orientation $\tilde{X}$. At block 86, new pan, tilt, and focus control values Ub are obtained, such that the spotlight shines on the target location Ra. In an other example embodiment, the current control signal Ua is provided, and the location of the resulting spotlight Rb is measured. It can be appreciated that different approaches for obtaining additional R,U pairs can be used with the example embodiments described herein.

At block 88, the new R,U pair or pairs are used with the Kalman filter to generate an updated estimate of $\tilde{X}$. This can be done using the examples described with respect to FIG. 6 and FIG. 7. The new or updated estimate $\tilde{X}$ can then be verified according the verify calibration phase 30 (block 90).

Figure 10:
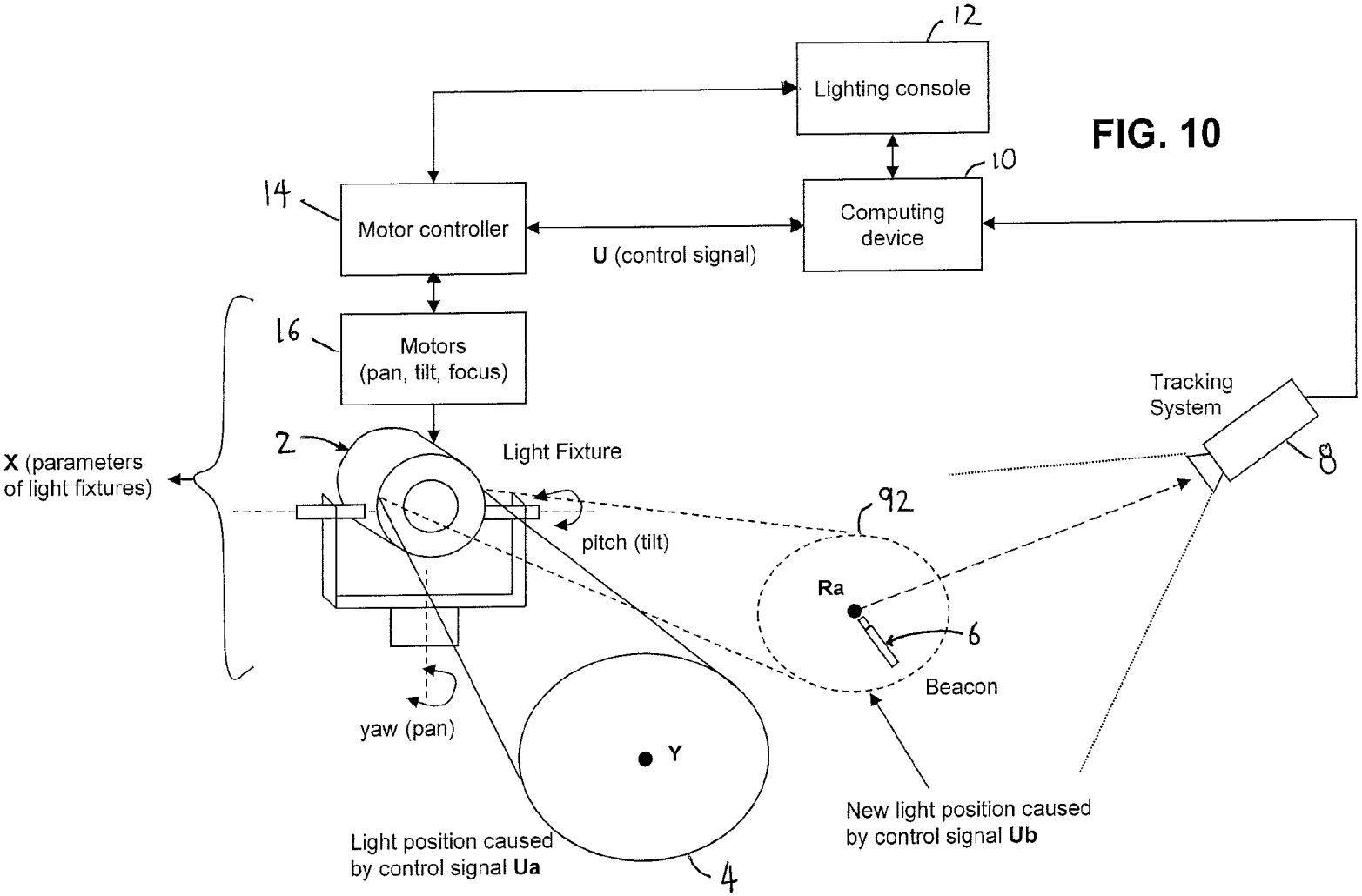
FIG. 10 is a schematic diagram of an example light fixture, a computing device, a tracking system, and a beacon used to collect calibration points.
Figure 11:
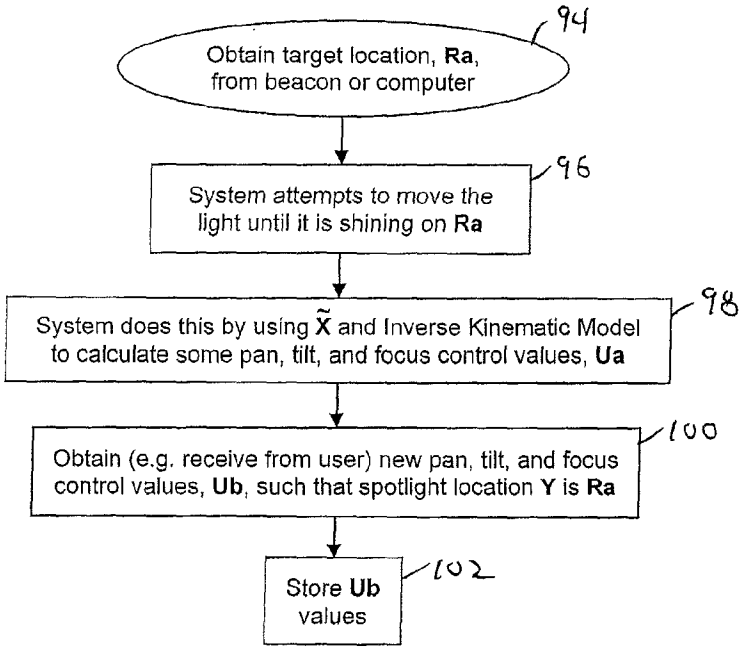
FIG. 11 is a flow diagram illustrating example computer executable instructions for collecting calibration points using a beacon.

Turning to FIG. 10 and FIG. 11, an example embodiment is provided for obtaining an R,U pair. This can be applied to blocks 34 and 50, for example. FIG. 10 shows the system components and FIG. 11 shows example computer executable instruction for obtaining an R,U pair.

The location of the beacon 6 can be used to define a target location Ra (block 94). The tracking system 8 tracks the beacon 6 and outputs the coordinates for Ra. The system then attempts to move the light fixture 2 to point the spotlight 4 onto Ra (block 96). The computing device 10 uses the values of $\tilde{X}$ and the inverse kinematic model 26 to calculate the control values Ua (block 98). However, control values Ua are then inputted to the controller 14. The light fixture 2, as a result of the controller 14, moves in a certain direction. However, the resulting location Y of the spotlight may not coincide with Ra. Therefore, at block 100, the computing device 10 receives new pan, tilt and focus control values Ub such that the spotlight location Y now coincides with Ra. The new Ub values can be determined, for example, based on inputs provided by a user interacting with the lighting console 12. A user can be adjusting the pan, tilt and control.

The values Ra and Ub are considered a corresponding R,U pair that can be used to define the behaviour of the lighting system.

Figure 12:
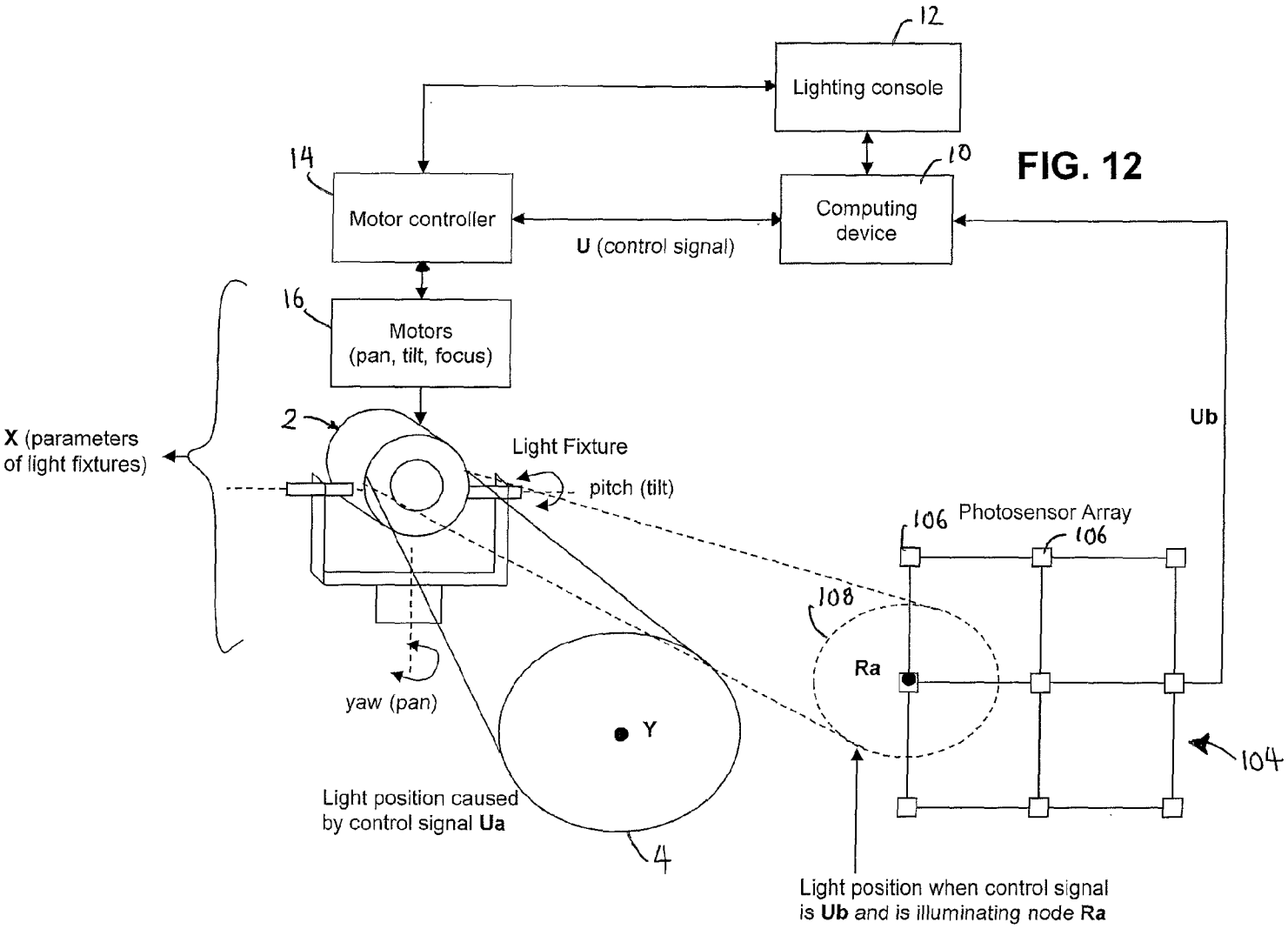
FIG. 12 is a schematic diagram of an example light fixture, a computing device, a tracking system, and a photosensor array used to collect calibration points.
Figure 13:
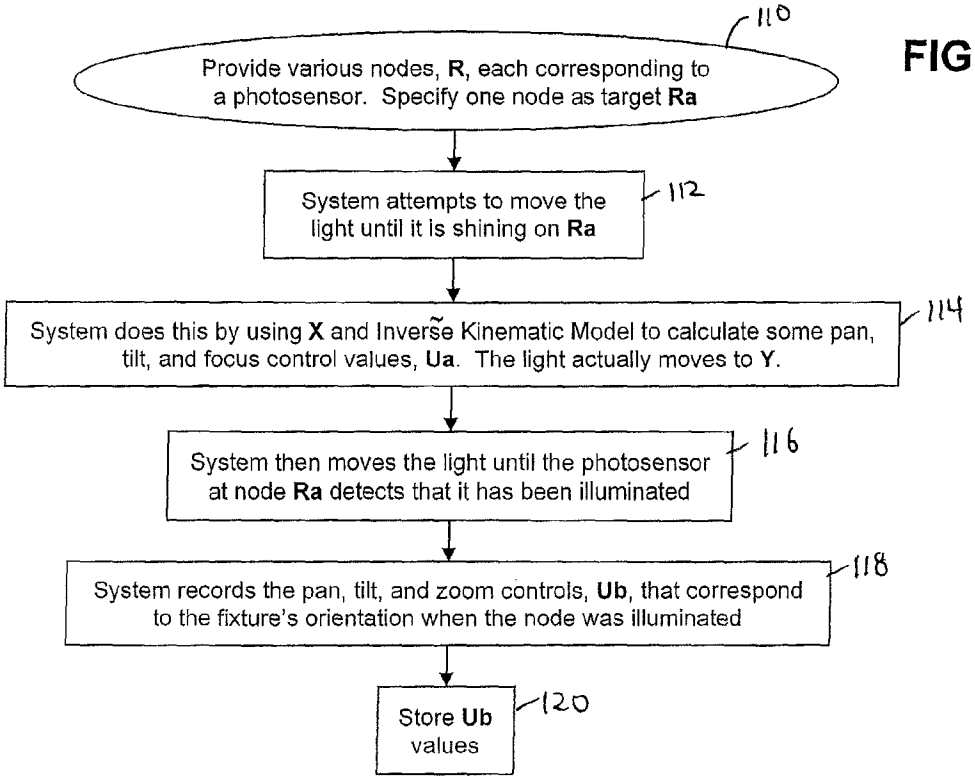
FIG. 13 is a flow diagram illustrating example computer executable instructions for collecting calibration points using a photosensor array.

Turning to FIG. 12 and FIG. 13 another example embodiment is provided for obtaining an R,U pair. FIG. 12 shows a system including a photosensor array 104. The photosensor array 104 includes one or more photosensors 106. The sensors 10 detect the intensity of light, and can provide a signal to detect whether or not the spotlight is shining on it.

The sensors 106 can be arranged in a grid, or in a random fashion. The location (e.g. x,y,z coordinates) of each sensor 106 is known by the computing device 10. Each location of a sensor 106 can be considered a target point R. The array 104 is in communication with the computing device 10. More generally, the sensor is a feedback device with a known location. The feedback device provides feedback about whether the light, or other projectile media (e.g. water, fluid, bullet, line of sight of a camera, etc.) is being directed onto the sensor. Depending on the application (e.g. may not be related to light), the feedback device would have a different construction than a photosensor. For example, the feedback device may be a pressure sensor.

Referring to FIG. 13, example computer executable instructions are provided for obtaining an R,U pair. At block 110, the various target locations R are provided, each corresponding with a location of a photosensor 106. One of the sensors 106 is specified as the target Ra. At block 112, the system attempts to move the spotlight to shine on Ra. At block 114, the computing device 10 uses $\tilde{X}$ and the inverse kinematic model 26 to compute the control signal Ua, which in turn is used to control the light fixture 2 and the location Y of the spotlight. At block 116, if the location Y does not correspond with Ra (e.g. the photosensor 6 does not detect the light), then the system continues to move the spotlight until it shines on the photosensor 106 coinciding with Ra (block 118). The control values Ub that correspond to the location of the spotlight Y coinciding with Ra are recorded (block 120). Thus, the R,U pair is Ra,Ub.

Figure 14:
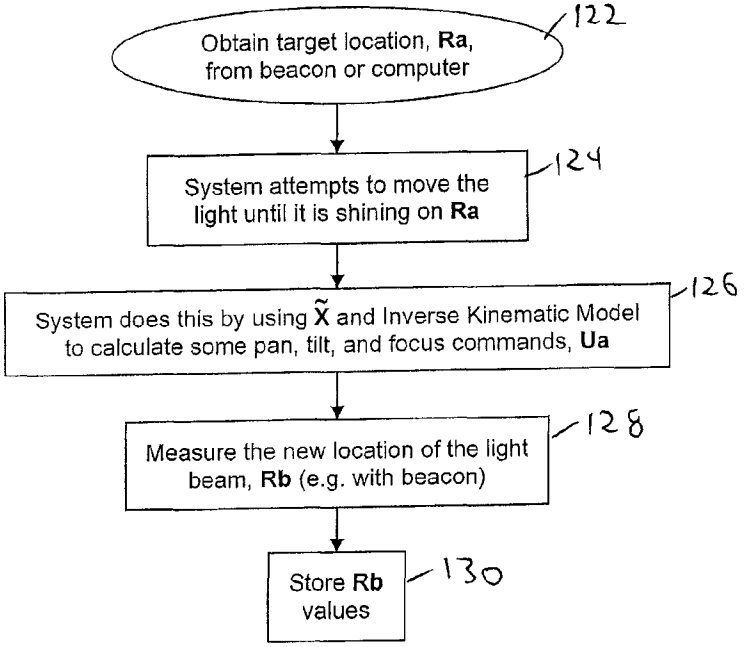
FIG. 14 is a flow diagram illustrating example computer executable instructions for collecting calibration points using a beacon according to another example embodiment.

In another example approach, which uses the system shown in FIG. 10, a beacon 6 can be used. Turning to FIG. 14, a target location Ra is obtained, for example, as defined by the beacon 6 or by the computer or a user (block 122). At block 124, the system attempts to move the location Y of the spotlight to coincide with Ra, for example using the inverse kinematic model to compute control value Ua (block 126). However, if the location Y of the spotlight does not does not correspond with Ra, then the actual location of the spotlight Y can be measured (block 128). The measured location corresponds with the control value Ua. The location Y of the spotlight can be measured by placing the beacon 6 within the spotlight. The measured location of the spotlight is Rb, which is stored in the computing device 10 (block 130). Thus, the R,U pair is Rb,Ua.

Figure 15:
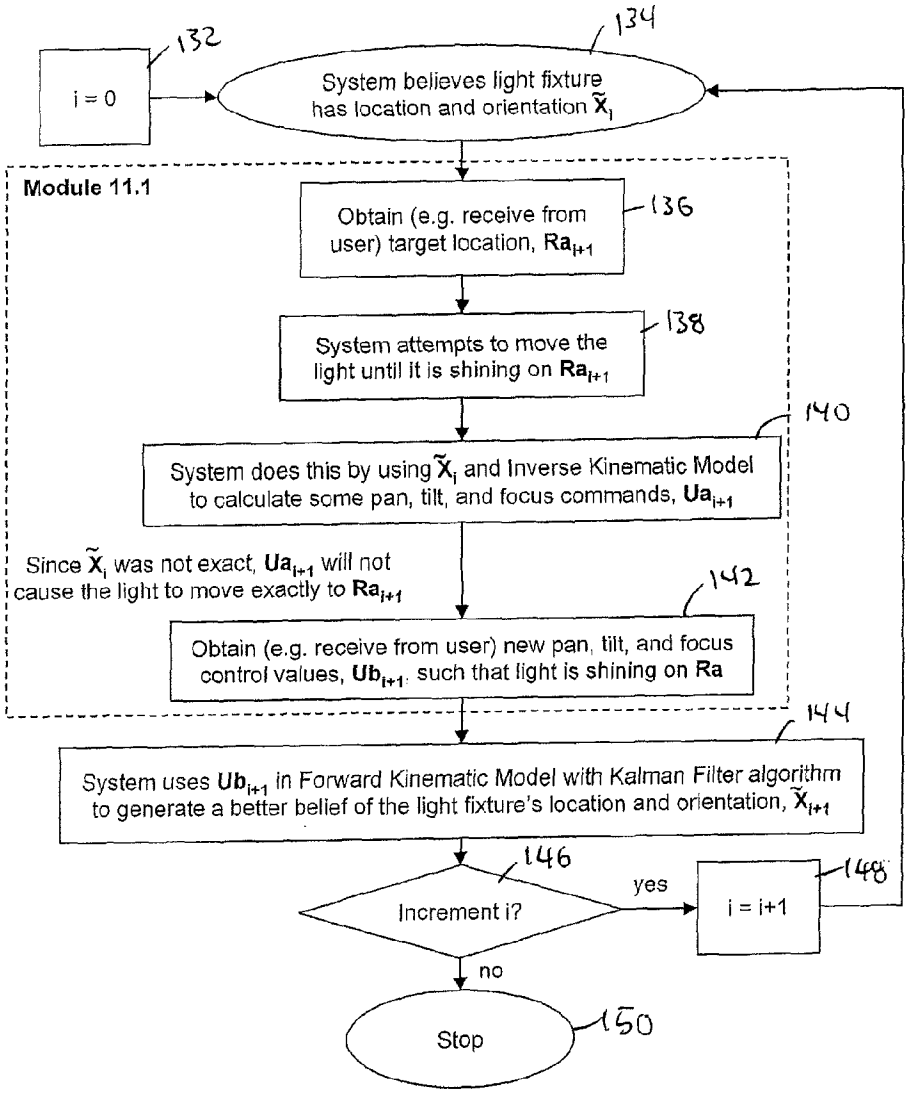
FIG. 15 is a flow diagram illustrating example computer executable instructions for calibrating a light fixture according to another example embodiment.
Figure 16:
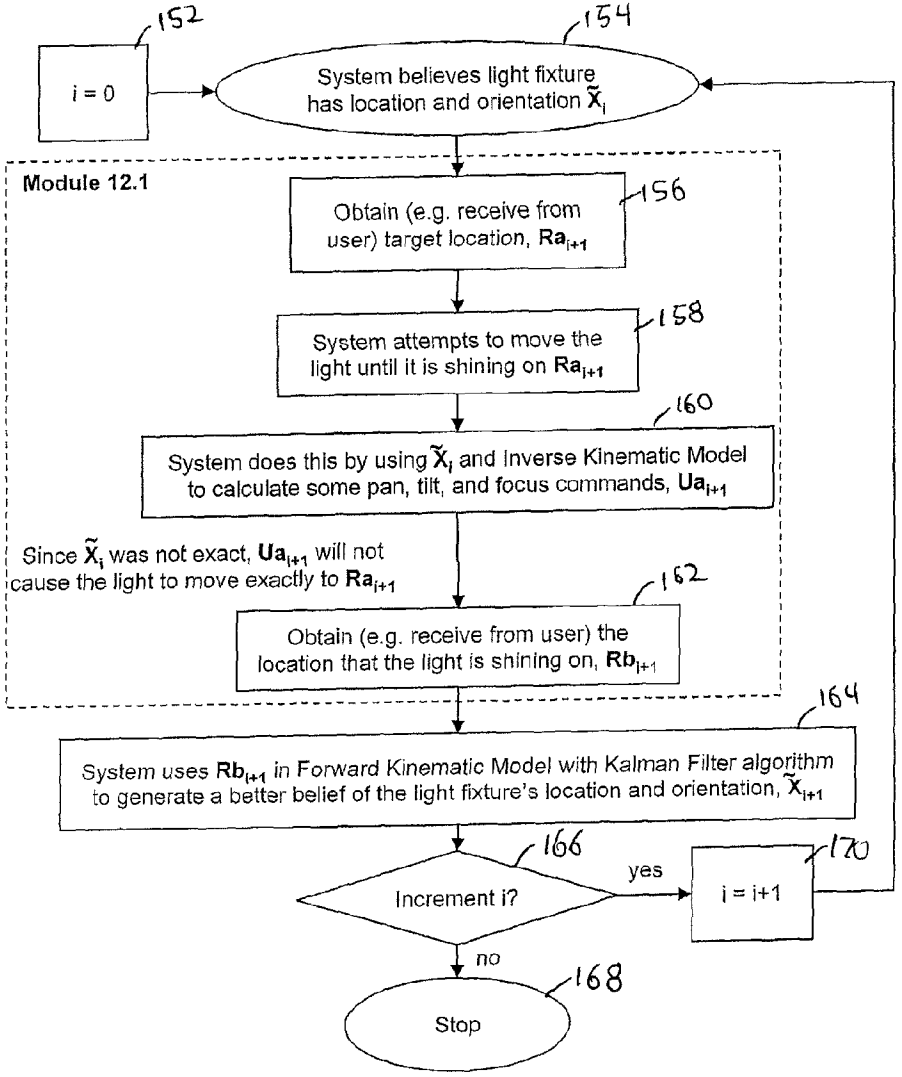
FIG. 16 is a flow diagram illustrating example computer executable instructions for calibrating a light fixture according to another example embodiment.

FIG. 15 and FIG. 16 provide other example embodiments for calibrating a light.

Turning to FIG. 15, an iteration value i is set to 0 (block 132). The system believes light fixture has location and orientation $\tilde{X}_i$ (block 134). Module 11.1 includes blocks 136, 138, 140 and 142. At block 136, the computing device obtains (e.g. receive from user) a target location, $Ra_{i+1}$. At block 138, the system attempts to move the light until it is shining on $Ra_{i+1}$. At block 140, the system does this by using $\tilde{X}_i$ and the inverse kinematic model to calculate some pan, tilt, and focus commands, $Ua_{i+1}$. At block 142, the computing device 10 obtains (e.g. receive from user) new pan, tilt, and focus control values, $U_{bi+1}$, such that light is shining on Ra.

At block 144, the system uses $U_{bi+1}$ in a forward kinematic model with a Kalman filter algorithm to generate a better belief (e.g. estimate) of the light fixture's location and orientation, $\tilde{X}_{i+1}$.

At block 146, it is determined if i should be incremented. If not, the process stops (block 150). If so, i is incremented by one (block 148) and the process iterates with block 134.

Turning to FIG. 16, the operations shown in blocks 152, 154, 156, 158, 160, 162 164, 166, 168, and 170 are similar to those operations in FIG. 15. However, at block 162, the location that the light is shining on is measured at $Rb_{i+1}$, and in block 164, the value $Rb_{i+1}$ is used to generate an estimate of $\tilde{X}_{i+1}$.

Figure 17:
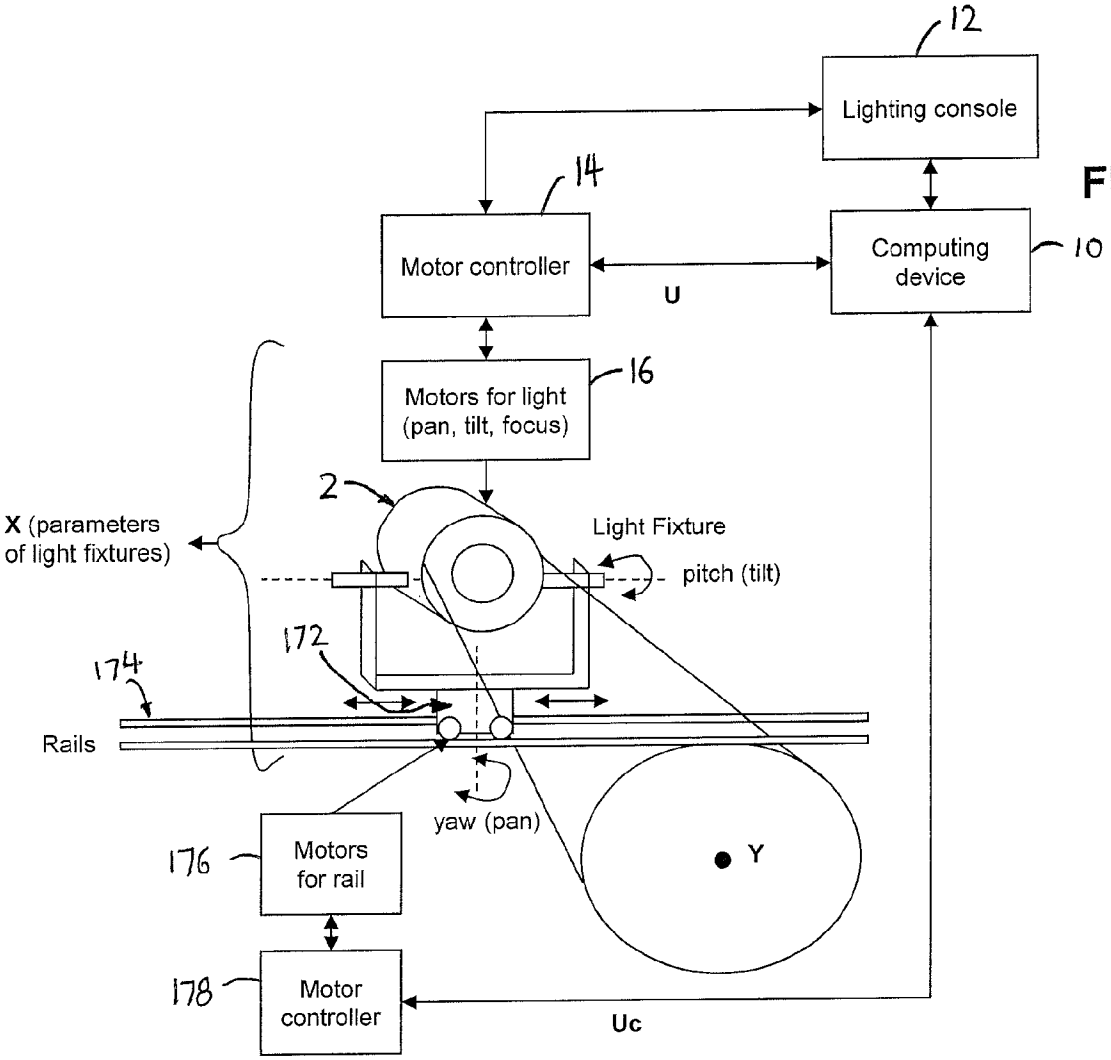
FIG. 17 is a schematic diagram of an example light fixture that is able to change position, a computing device, and a tracking system used to calibrate the moveable light fixture.

Turning to FIG. 17, an example embodiment is provided where the position of the light fixture 2 is able to move. For example, the light fixture 2 may be on a robotic arm, on a pulley, or attached to some other moving system. Other systems for moving the light fixture are also applicable.

In FIG. 17, the light fixture 2 is positioned on a moving carriage 172. The carriage 172 is able to move along rails 174. The carriage 176 can include motors 176 for moving the carriage and a motor controller 178. The computing device 10 and the motor controller 178 may be in communication with each other.

The calibration process described above can also be used to account for the changing position of the light fixture.

Figure 18:
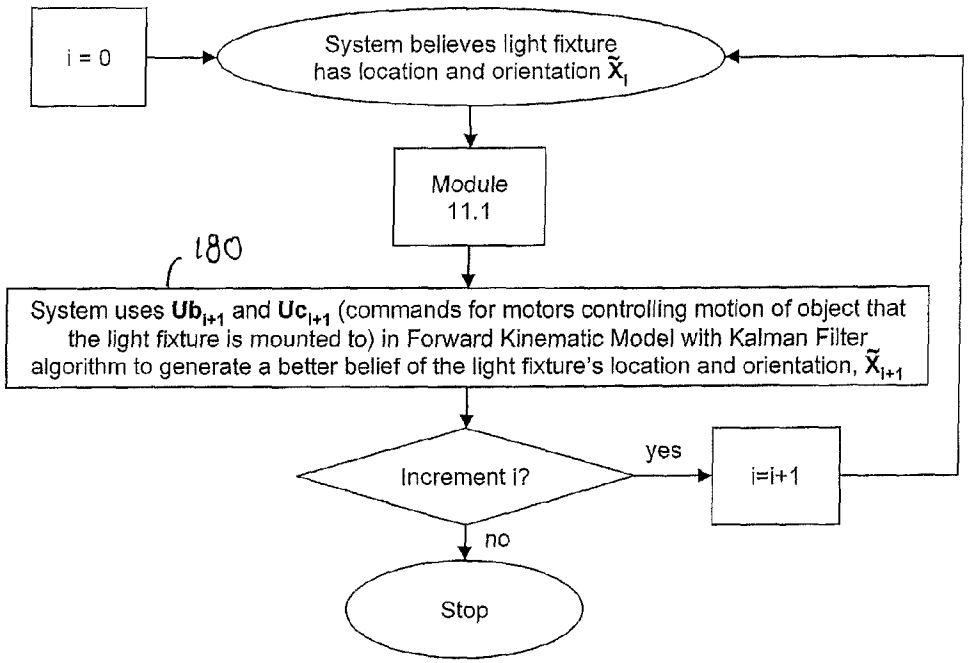
FIG. 18 is a flow diagram illustrating example computer executable instructions for calibrating a moveable light fixture.

Turning to FIG. 18, example computer executable instructions are provided which use the operations described in FIG. 15 (e.g. Module 11.1). In addition, at block 180, the system uses $Ub_{i+1}$ and $Uc_{i+1}$ (e.g. commands for motors controlling motion of the carriage that the light fixture is mounted to) in the forward kinematic model with the Kalman filter algorithm to generate a better belief of the light fixture's location and orientation, $\tilde{X}_{i+1}$.

Figure 19:
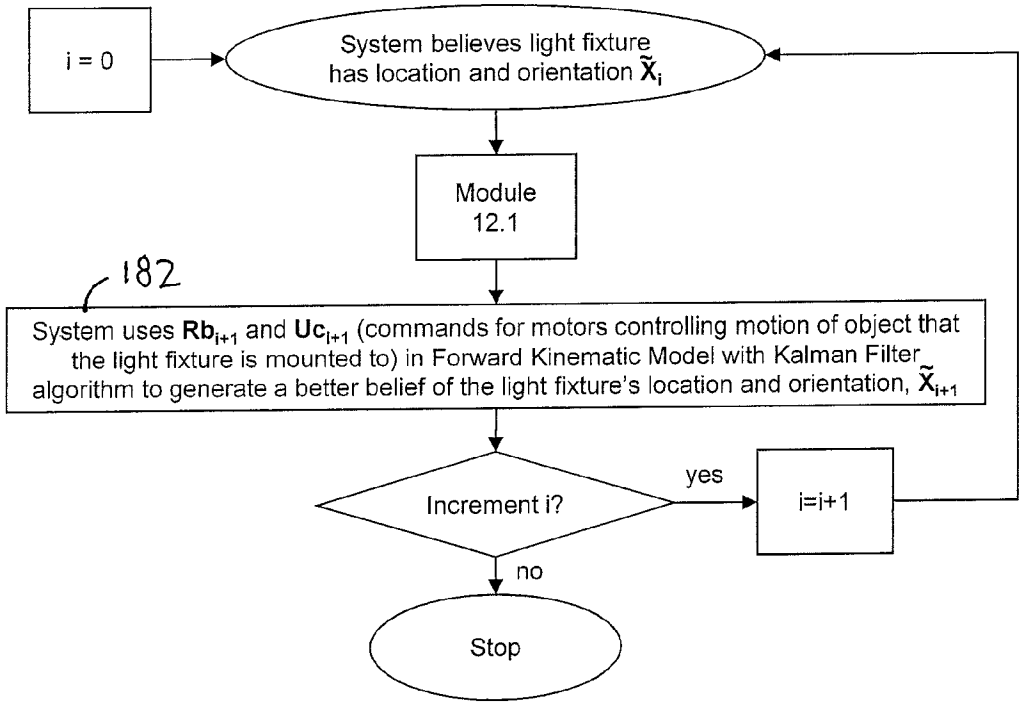
FIG. 19 is a flow diagram illustrating example computer executable instructions for calibrating a moveable light fixture according to another example embodiment.

Turning to FIG. 19, example computer executable instructions are provided which use the operations described in FIG. 16 (e.g. Module 12.1). In addition, at block 182, the system uses $Rb_{i+1}$ and $Uc_{i+1}$ (e.g. commands for motors controlling motion of the carriage that the light fixture is mounted to) in the forward kinematic model with the Kalman filter algorithm to generate a better belief of the light fixture's location and orientation, $\tilde{X}_{i+1}$.

It will be appreciated that any module or component exemplified herein that executes instructions or operations may include or otherwise have access to computer readable media such as storage media, computer storage media, or data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data, except transitory propagating signals per se. Examples of computer storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by an application, module, or both. Any such computer storage media may be part of the computing device 10, tracking system 8, lighting console 12, controller 14 or accessible or connectable thereto. Any application or module herein described may be implemented using computer readable/executable instructions or operations that may be stored or otherwise held by such computer readable media.

It can be appreciated that the above examples allow equipment to be quickly and accurately calibrated.

Applications of the above examples can be applied to lighting, audio, and entertainment marketplaces, military, security, medical applications, scientific research, child care supervision, sports, etc.

In a general embodiment, a method is provided for calibrating a fixture configured to at least one of rotate and translate. The method includes: obtaining a kinematic model of the fixture; obtaining one or more test points; and using the one or more test points to update the kinematic model of the fixture.

In an aspect, the one or more test points include a desired location R at which the fixture is to point, and a corresponding control signal U for controlling the fixture. In another aspect, a beacon and a tracking system for tracking the position of the beacon is used to measure the desired location R. In another aspect, a sensor having a known location is used to measure the desired location R, the sensor configured to detect whether media projected from the fixture is directed onto the sensor. In another aspect, at least six R, U pairs are obtained as test points. In another aspect, the kinematic model of the fixture is associated with parameters of the fixture, represented by X, the parameters including position and orientation of the fixture, and a transformation used to convert a desired movement of the fixture to a control signal. In another aspect, the one or more test points are used to compute updated parameters of X, represented by $\tilde{X}$, to update the kinematic model. In another aspect, a Kalman operation is used to compute $\tilde{X}$. In another aspect, the method further includes verifying whether the updated kinematic model is calibrated. In another aspect, verifying whether the updated kinematic model is calibrated includes: obtaining a new target location; computing new control signals based on an inverse kinematic model of the fixture to move the fixture at the new target location; using the new control signals to move the fixture; measuring an actual location at which the moved fixture is pointed; and comparing the actual location with the desired location to verifying whether the updated kinematic model is calibrated. In another aspect, if the updated kinematic model is not calibrated, the method further comprises computing another updated calibrated kinematic model using one or more new test points. In another aspect, the fixture is a light fixture and the kinematic model of the light fixture is associated with parameters of the light fixture, represented by X, the parameters including position and orientation of the light fixture, a transformation used to convert a desired movement of the fixture to a movement control signal, and another transformation used to convert a desired focus setting of the light fixture to a focus control signal. In another aspect, the fixture is at least one of a camera, a projector, a microphone, an audio speaker, a projectile device, and a fluid cannon.

The schematics and block diagrams used herein are just for example. Different configurations and names of components can be used. For instance, components and modules can be added, deleted, modified, or arranged with differing connections without departing from the spirit of the invention or inventions.

The steps or operations in the flow charts and diagrams described herein are just for example. There may be many variations to these steps or operations without departing from the spirit of the invention or inventions. For instance, the steps may be performed in a differing order, or steps may be added, deleted, or modified.

It will be appreciated that the particular embodiments shown in the figures and described above are for illustrative purposes only and many other variations can be used according to the principles described. Although the above has been described with reference to certain specific embodiments, various modifications thereof will be apparent to those skilled in the art as outlined in the appended claims.

The invention claimed is:

1. A method performed by a computing system for calibrating a fixture configured to at least one of rotate and translate, the method comprising:

storing in memory of the computing system an initial kinematic model of the fixture, the initial kinematic model associated with initial kinematic parameters of the fixture, the initial kinematic parameters comprising initial position coordinates and initial orientation angles of the fixture, and an initial transformation for converting a desired movement of the fixture to a control signal for controlling the fixture;

obtaining and storing multiple pairs of test points in the memory, each pair of test points comprising a location at which the fixture is pointing and a corresponding control signal for controlling the fixture, wherein obtaining a given pair of test points comprises:

the computing device sending a given control signal configured to control the fixture;

the computing device receiving external data comprising a given location of a beacon at which the fixture is pointing, the external data configured to be communicated by a tracking system that tracks the beacon;

the computing system associating the given control signal and the given location with each other as the given pair; and using the multiple pairs of test points and the initial kinematic parameters to compute calibrated kinematic parameters of the fixture, and using the calibrated kinematic parameters to generate a calibrated kinematic model of the fixture;

computing a new control signal using the calibrated kinematic model and the computing system sending the new control signal which is configured to control the fixture.

2. The method of claim 1 wherein at least six pairs of test points are obtained.

3. The method of claim 1 wherein a Kalman operation is used to compute the calibrated kinematic parameters of the kinematic model.

4. The method of claim 1 further comprising verifying whether the calibrated kinematic model is calibrated.

5. The method of claim 4 wherein verifying whether the calibrated kinematic model is calibrated comprises: obtaining a new target location; computing new control signals based on an inverse kinematic model of the fixture to move the fixture at the new target location; using the new control signals to move the fixture; measuring an actual location at which the moved fixture is pointed; and comparing the actual location with the desired location to verify whether the calibrated kinematic model is calibrated.

6. The method of claim 4 wherein, if the calibrated kinematic model is not calibrated, the method further comprises computing another updated calibrated kinematic model using one or more new pairs of test points.

7. The method of claim 1 wherein the fixture is a light fixture and wherein the initial kinematic model of the light fixture is associated with initial kinematic parameters of the light fixture, the initial kinematic parameters of the light fixture further comprising another transformation used to convert a desired focus setting of the light fixture to a focus control signal for controlling the light fixture.

8. The method of claim 1 wherein the fixture is at least one of a camera, a projector, a microphone, an audio speaker, a projectile device, and a fluid cannon.

9. A non-transitory computer readable medium for calibrating a fixture configured to at least one of rotate and translate, the non-transitory computer readable medium storing an initial kinematic model of the fixture, the initial kinematic model associated with initial kinematic parameters of the fixture, the initial kinematic parameters comprising initial position coordinates and initial orientation angles of the fixture, and an initial transformation for converting a desired movement of the fixture to a control signal for controlling the fixture and the non-transitory computer readable medium further comprising computer executable instructions that when executed cause a computing system to at least:

obtain and store multiple pairs of test points in the non-transitory computer readable medium, each pair of test points comprising a location at which the fixture is pointing and a corresponding control signal for controlling the fixture, wherein obtaining a given pair of test points comprises:

the computing device sending a given control signal configured to control the fixture;

the computing device receiving external data comprising a given location of a beacon at which the fixture is pointing, the external data configured to be communicated by a tracking system that tracks the beacon;

the computing system associating the given control signal and the given location with each other as the given pair; and use the multiple pairs of test points and the initial kinematic parameters to compute calibrated kinematic parameters of the fixture, and use the calibrated kinematic parameters to generate a calibrated kinematic model of the fixture;

compute a new control signal using the calibrated kinematic model; and send the new control signal which is configured to control the fixture.

10. The non-transitory computer readable medium of claim 9 wherein at least six pairs of test points are obtained.

11. The non-transitory computer readable medium of claim 9 wherein a Kalman operation is used to compute the calibrated kinematic parameters of the kinematic model.

12. The non-transitory computer readable medium of claim 9 further comprising verifying whether the calibrated kinematic model is calibrated.

13. The non-transitory computer readable medium of claim 9 wherein the fixture is a light fixture and wherein the initial kinematic model of the light fixture is associated with initial kinematic parameters of the light fixture, the initial kinematic parameters of the light fixture further comprising another transformation used to convert a desired focus setting of the light fixture to a focus control signal for controlling the light fixture.

14. The non-transitory computer readable medium of claim 9 wherein the fixture is at least one of a camera, a projector, a microphone, an audio speaker, a projectile device, and a fluid cannon.

15. A system for calibrating a fixture configured to at least one of rotate and translate, the system comprising:

a computing system;

a beacon;

a tracking system that tracks a beacon location and is in communication with the computing system;

the computing system comprising memory that stores an initial kinematic model of the fixture, the initial kinematic model associated with initial kinematic parameters of the fixture, the initial kinematic parameters comprising initial position coordinates and initial orientation angles of the fixture, and an initial transformation for converting a desired movement of the fixture to a control signal for controlling the fixture; and the computing system configured to cause the computing system to at least:

obtain and store multiple pairs of test points in the memory, each pair of test points comprising a location at which the fixture is pointing and a corresponding control signal for controlling the fixture, wherein obtaining a given pair of test points comprises:

sending a given control signal configured to control the fixture;

receiving external data comprising a given location of the beacon at which the fixture is pointing, the external data configured to be communicated by the tracking system;

associating the given control signal and the given location with each other as the given pair;

use the multiple pairs of test points and the initial kinematic parameters to compute calibrated kinematic parameters of the fixture, and use the calibrated kinematic parameters to generate a calibrated kinematic model of the fixture;

compute a new control signal using the calibrated kinematic model; and send the new control signal which is configured to control the fixture.

16. The system of claim 15 wherein at least six pairs of test points are obtained.

17. The system of claim 15 wherein a Kalman operation is used to compute the calibrated kinematic parameters of the kinematic model.

18. The system of claim 15 further comprising verifying whether the calibrated kinematic model is calibrated.

19. The system of claim 15 wherein the fixture is a light fixture and wherein the initial kinematic model of the light fixture is associated with initial kinematic parameters of the light fixture, the initial kinematic parameters of the light fixture further comprising another transformation used to convert a desired focus setting of the light fixture to a focus control signal for controlling the light fixture.

20. The system of claim 15 wherein the fixture is at least one of a camera, a projector, a microphone, an audio speaker, a projectile device, and a fluid cannon.

21. A kit of parts for calibrating a fixture configured to at least one of rotate and translate, the kit of parts comprising:

a computing system;

a beacon;

a tracking system that tracks a beacon location and is in communication with the computing system;

the computing system comprising memory that stores an initial kinematic model of the fixture, the initial kinematic model associated with initial kinematic parameters of the fixture, the initial kinematic parameters comprising initial position coordinates and initial orientation angles of the fixture, and an initial transformation for converting a desired movement of the fixture to a control signal for controlling the fixture; and the computing system configured to cause the computing system to at least:

obtain and store multiple pairs of test points in the memory, each pair of test points comprising a location at which the fixture is pointing and a corresponding control signal for controlling the fixture, wherein obtaining a given pair of test points comprises:

sending a given control signal configured to control the fixture;

receiving external data comprising a given location of the beacon at which the fixture is pointing, the external data configured to be communicated by the tracking system;

associating the given control signal and the given location with each other as the given pair;

use the multiple pairs of test points and the initial kinematic parameters to compute calibrated kinematic parameters of the fixture, and use the calibrated kinematic parameters to generate a calibrated kinematic model of the fixture;

compute a new control signal using the calibrated kinematic model; and send the new control signal which is configured to control the fixture.

* * * * *